US005165151A

United States Patent [19]

Nakagawa

[11] Patent Number: 5,165,151

[45] Date of Patent: Nov. 24, 1992

[54] SHEARING APPARATUS

[76] Inventor: Chieko Nakagawa, 442-3, Ooaza Ooka, anou-cho, Agei-gun, mio-pref, Japan

[21] Appl. No.: 857,322

[22] Filed: Mar. 25, 1992

[51] Int. Cl.[5] ..... D06C 23/02

[52] U.S. Cl. ..... 26/16; 28/163; 83/869; 83/76.1; 83/342; 83/349

[58] Field of Search ..... 83/861, 869, 76.1, 76.6, 83/76.7, 76.8, 76.9, 342, 349, 672; 26/15 R, 15 FB, 16, 8 C, 10 C, 7, 36; 28/113, 128, 132, 139, 163

[56] References Cited

U.S. PATENT DOCUMENTS

| | | | |
|---|---|---|---|
| 3,769,666 | 11/1973 | Kaufman | 26/15 R |
| 3,785,016 | 1/1974 | Hergert | 26/16 X |
| 3,969,797 | 7/1976 | Riedel et al. | 26/15 R |
| 4,484,505 | 11/1984 | Lewallyn | 83/869 |
| 4,793,033 | 12/1988 | Schneider et al. | 26/16 |

FOREIGN PATENT DOCUMENTS

| | | | |
|---|---|---|---|
| 2093876 | 9/1982 | United Kingdom | 26/16 |

*Primary Examiner*—Douglas D. Watts
*Assistant Examiner*—Eugenia A. Jones
*Attorney, Agent, or Firm*—Moonray Kojima

[57] ABSTRACT

This invention provides a shearing apparatus for shearing, between a spiral cutter and a lower blade, tip ends of numerous piles formed on a foundation of a pile fabic. The shearing apparatus has a construction for producing fine design patterns, and comprises a plurality of elements each including a thin main body vertically movably mounted in a slit defined in an element block, and a thick head formed integral with the thin main body for pressing the foundation toward the spiral cutter. The thick heads of the elements are arranged close to one another without gaps in between over an entire axial length of the spiral cutter. Each of the elements further includes a leg formed integral with a lower portion of the thin main body to be offset from legs of adjacent elements. A cylinder mounting block disposed below the element block has piston rods of air cylinders arranged in positions opposed to the respective legs.

3 Claims, 15 Drawing Sheets

SHEARING APPARATUS

SUMMARY OF THE INVENTION

This invention relates to a shearing apparatus for shearing, between a spiral cutter and a lower blade, tip ends of numerous piles formed on a foundation of a pile fabric. The shearing apparatus has a construction for producing fine design patterns, and comprises a plurality of elements each including a thin main body vertically movably mounted in a slit defined in an element block, and a thick head formed integral with the thin main body for pressing the foundation toward the spiral cutter. The thick heads of the elements are arranged close to one another without gaps in between over an entire axial length of the spiral cutter. Each of the elements further includes a leg formed integral with a lower portion of the thin main body to be offset from legs of adjacent elements. A cylinder mounting block disposed below the element block has piston rods of air cylinders arranged in positions opposed to the respective legs.

BACKGROUND OF THE INVENTION

FIGS. 14 and 15 show an example of conventional shearing apparatus similar to the apparatus noted above. In the illustrated example, a main roll body 91 has a rotating roll 93 mounted on a surface thereof and defining ridges 92 as integral parts of the roll 93 for producing a predetermined design pattern. This rotating roll 93 is placed under a spiral cutter 94. As a pile fabric 97 having a multiplicity of piles 96 formed on a foundation 95 is transported by a transport device (not shown) in the direction of an arrow in FIG. 14, tip ends of the piles 96 are sheared between the spiral cutter 94 and a lower blade 98.

According to this conventional apparatus, the piles 96 corresponding to the ridges 92 are cut short, while the piles 96 corresponding to the main roll body 91 are cut long. Although this apparatus has the advantage of providing the predetermined design pattern, the pattern is only repeated in a fixed manner according to the configuration of the ridges 92 on the rotating roll 93. Not only is a different rotating roll having ridges 92 in a different configuration required to produce a different design pattern, but a simple repetition of the pattern is obtained.

To overcome the above disadvantage, Applicants have invented a shearing apparatus as disclosed in the Japanese patent application laid open under No. 60(i.e. 1985)-75662.

This prior shearing apparatus includes a plurality of elements vertically movably arranged on an element block. These elements are individually projected by piston rods of air cylinders. Air supply to the air cylinders is effected and stopped under control of a control unit based on signals received from a pattern reader, thereby producing varied design patterns.

In this prior apparatus, however, the above elements inevitably are arranged with gaps in between by reason of the outside diameter of cylinder tubes of the air cylinders provided for controlling these elements individually. It is therefore difficult t obtain fine design patterns although coarse design patterns may be obtained.

OBJECTS OF THE INVENTION

A primary object of this invention is to provide a shearing apparatus of unique construction having elements arranged close to one another with no gaps in between for producing fine design patterns.

Another object of this invention is to provide a shearing apparatus having an element cover of vertically movable construction for guiding the elements, thereby to adjust amounts of projection of the elements, so that the single apparatus is capable of shearing various types of fabrics from a blanket having long piles to a sheet having short piles for use in an automobile.

A further object of this invention is to provide a shearing apparatus having two stoppers for acting on the elements to effect two-stage control of amounts the elements are projected by air cylinders, thereby to be capable of clipping piles in two stages.

Other objects of this invention will be apparent from the following description of the preferred embodiments.

DETAILED DESCRIPTION OF THE PREFERRED EMBODIMENTS

An embodiment of this invention will be described in detail hereinafter with reference to the drawings.

Figure 1:
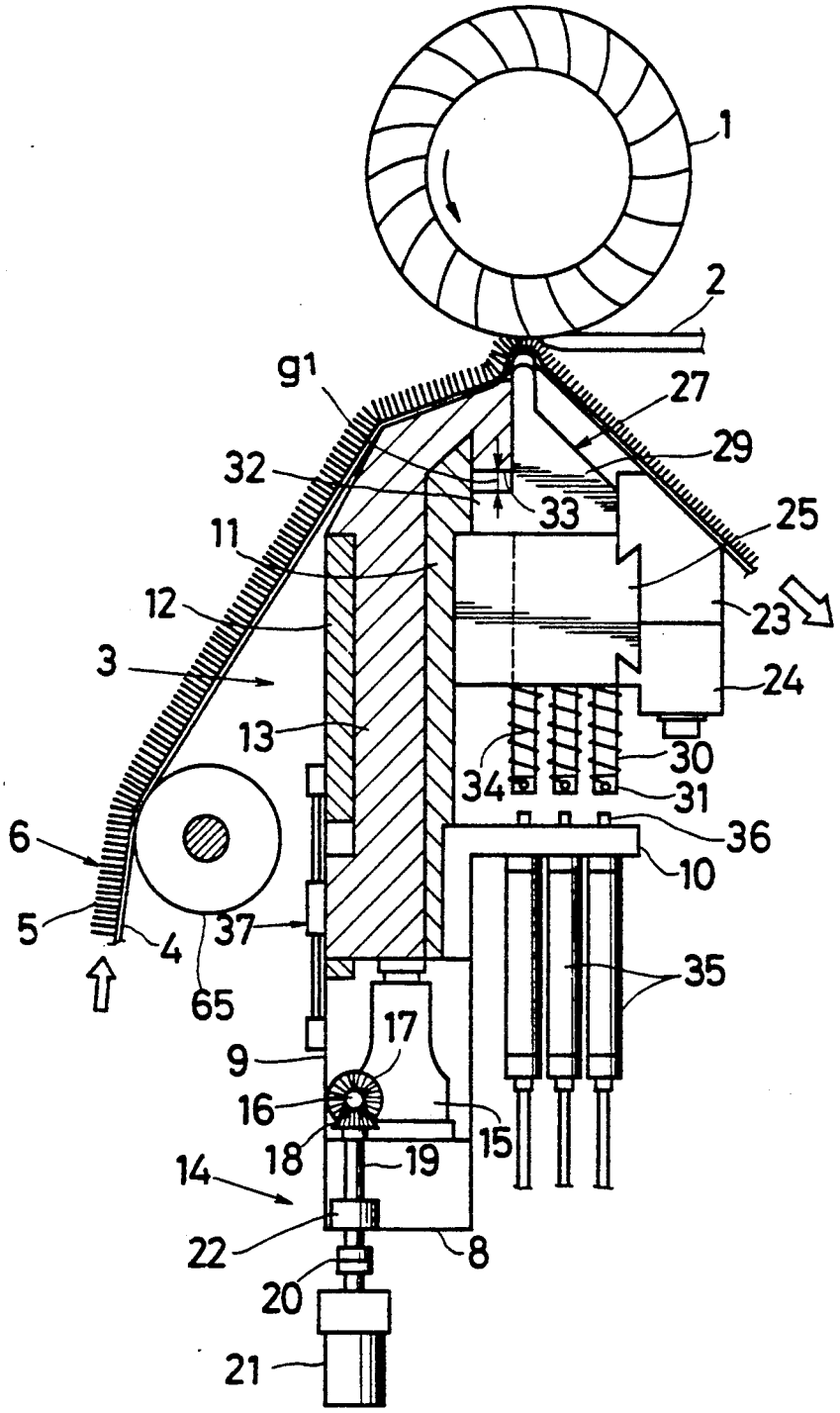
FIG. 1 is a side view of a shearing apparatus according to this invention.
Figure 2:
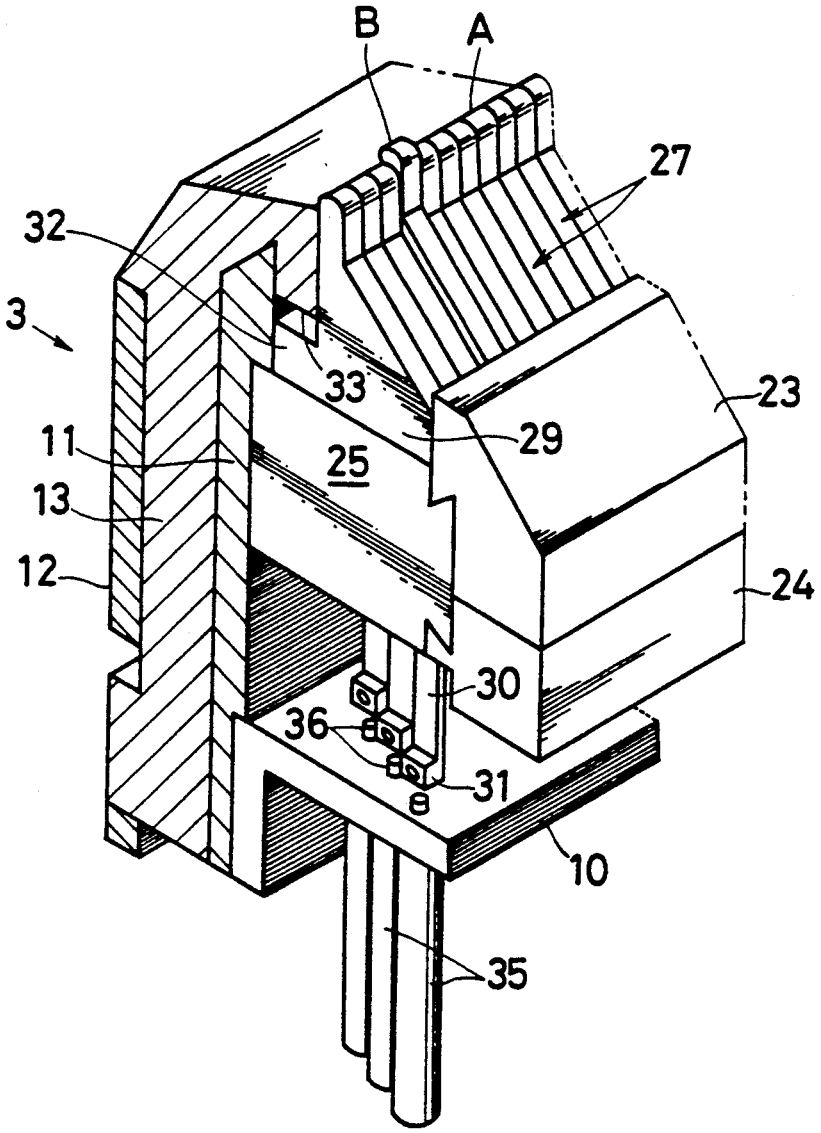
FIG. 2 is a perspective view of a principal portion of the apparatus shown in FIG. 1.

Referring to FIGS. 1 and 2, a shearing apparatus includes a spiral cutter 1 having an overall length of about 1.8 to 2.8 m, a lower blade 2 disposed below the spiral cutter 1, and a shearing table 3 disposed below the two components 1 and 2. As a pile fabric 6 having a multiplicity of piles 5 formed on a foundation 4 is transported by a transport device 7 (FIG. 7) in the direction of an arrow in FIG. 1, tip ends of the piles 5 are sheared between the spiral cutter 1 and lower blade 2.

The shearing table 3 includes a lifting base (shearing table base) 8, and an L-shaped cylinder mounting block 10 fixed to the top of the lifting base 8 through a supporter 9. The supporter 9 supports, fixedly erected thereon, an inner stationary element cover 11, an outer stationary element cover 12, and a movable element cover 13 disposed between the two stationary element covers 11 and 12. A first lifting device 14 is attached to a lower position of the movable element cover 13.

The first lifting device 14 is constructed, for example, as follows. The first lifting device 14 includes a worm jack 15 interposed between the lifting base 8 and movable element cover 13, a driven bevel gear 17 operatively connected through a shaft 16 to a worm mounted in the worm jack 15, a drive bevel gear 18 meshed with the driven bevel gear 17, a drive shaft 19 carrying the drive bevel gear 18 fitted on an upper end thereof, and a motor 21 connected to the drive shaft 19 through a coupling 20. The drive shaft 19 is attached to the lifting base 8 through a bearing 22.

An element block 25 is disposed over the cylinder mounting block 10. The element block 25 is supported at one side thereof by the inner stationary element cover 11 and at the other side by an element holder of split construction having an upper part 23 and a lower part 24. This element block 25 defines a plurality of slits 26 (see FIG. 4) in which metallic elements 27 are vertically movably arranged.

Figure 3:
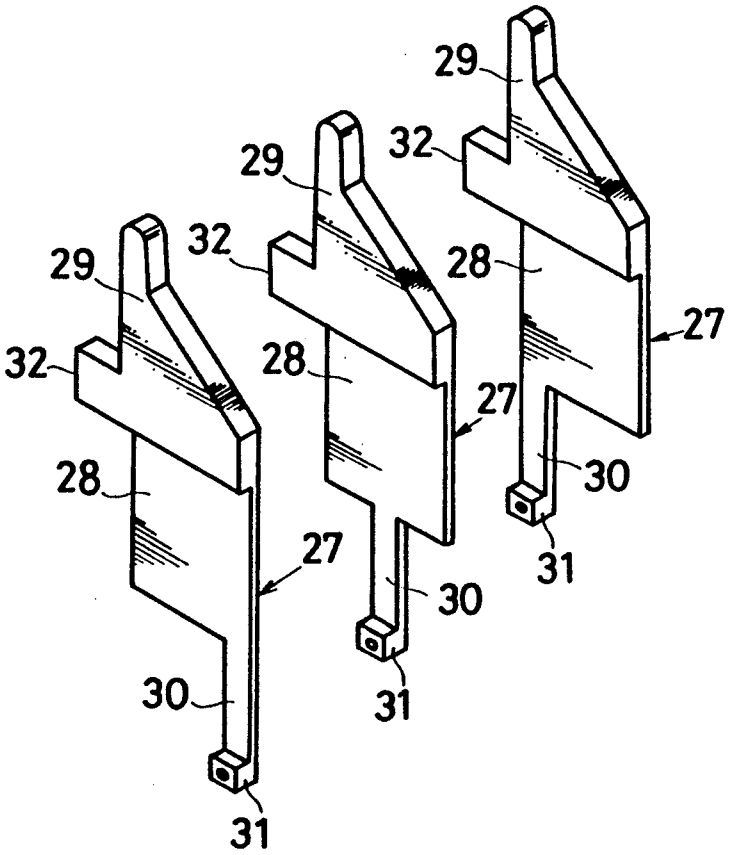
FIG. 3 is an exploded perspective view of elements.

The elements 27 are constructed as shown in FIG. 3. Each element 27 includes a thin main body 28 having a wall thickness of about 1.35 mm and vertically movably mounted in the slit 26 of the element block 25, and a thick head 29 having a wall thickness of about 2.5 mm and formed integral with an upper end of the thin main body 28 for pressing the foundation 4 toward the spiral cutter 1. As shown in FIG. 3, a leg 30 is formed integral with a lower end of the thin main body 28 to be offset from legs 30 of adjacent elements 27. The leg 30 has the same wall thickness as the thin main body 28, and includes a retainer 31 formed integral with a lower end thereof and having the same wall thickness as the thick head 29.

As shown in FIG. 2, the thick heads 29 of the numerous elements 27 are arranged close to one another without gaps in between over the entire axial length of the spiral cutter 1.

Each element 27 includes a projection 32 formed integral with and projecting from one side (left side in the drawings) of the thick head 29. On the other hand, the movable element cover 13 includes a first stopper 33 opposed to an upper surface of the projection 32. A first gap g1 is formed between the upper surface of the projection 32 and the first stopper 33, which is adjustable by driving the first lifting device 14.

Figure 4:
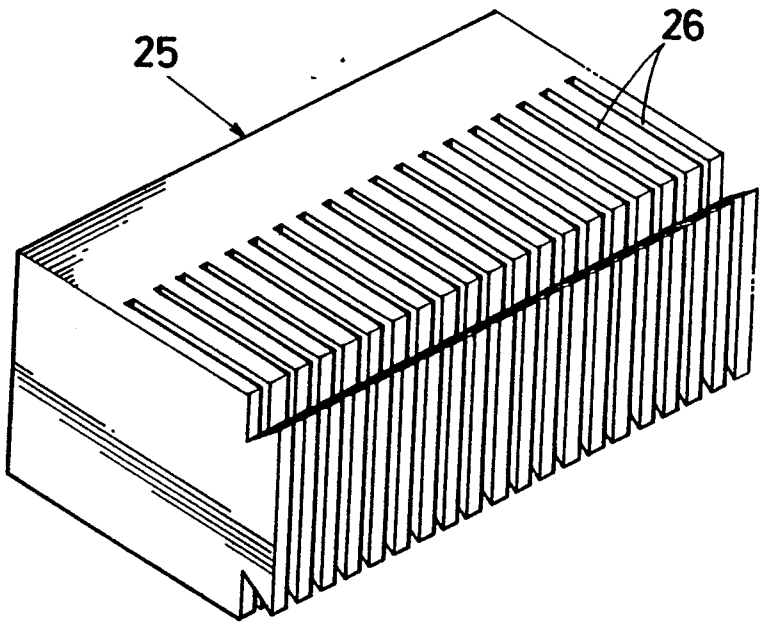
FIG. 4 is a partial perspective view of an element block.

As shown in FIG. 4, the element block 25 defines a plurality of slits 26 as noted hereinbefore for vertically movably accommodating the elements 27. These slits 26 have a width of about 1.35 mm and extend parallel to one another at intervals of about 2.5 mm. As seen from FIG. 4, these slits 26 are open at the other side to facilitate sideways insertion thereto of the elements 27 for efficiency of assembly.

A coil spring 34 is mounted between the retainer 31 at the lower end of the leg 30 of each element 27 assembled as above and a bottom surface of the element block 25. This coil spring 34 constantly biases each element 27 to a lower normal position.

Figure 5:
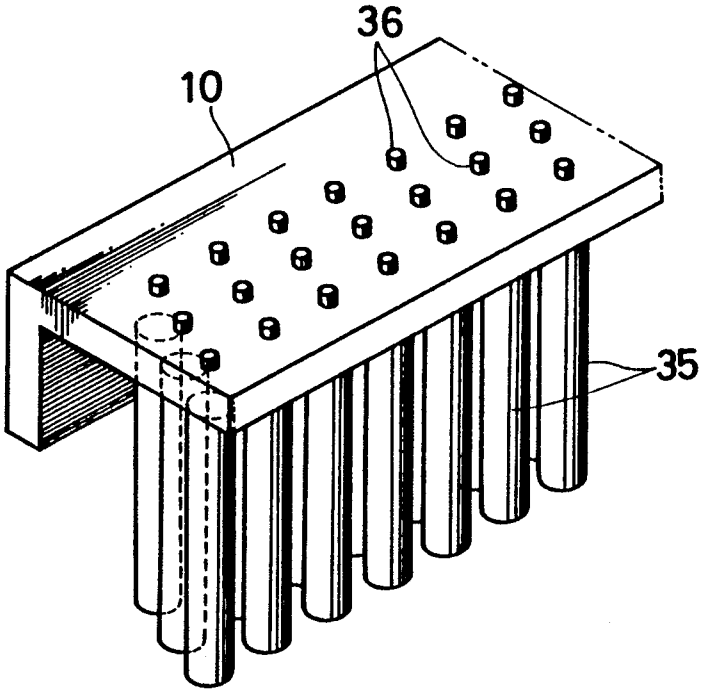
FIG. 5 is a partial perspective view of an air cylinder mounting structure.

The cylinder mounting block 10 disposed under the element block 25 has piston rods 36 of air cylinders 35 arranged in positions opposed to the mutually offset legs 30 as shown in FIG. 5.

Figure 6:
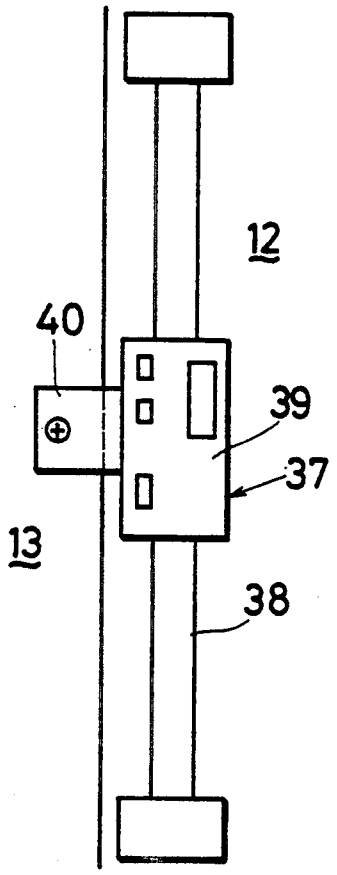
FIG. 6 is an explanatory view of a digital scale.

On the other hand, as shown in FIGS. 1 and 6, a digital scale 37 is mounted between the movable element cover 13 and outer stationary element cover 12. This digital scale 37, for example, includes a stationary bar 38 having a plurality of slits (not shown) for generating a pulse signal, a measuring instrument 39 slidable along the stationary bar 38, and a control piece 40 for moving the measuring instrument 39. The measuring instrument 39 contains a photoelectric sensor whose output is counted by an internal circuit, whereby vertical movement of the control piece 40 is shown on a digital display.

Figure 7:
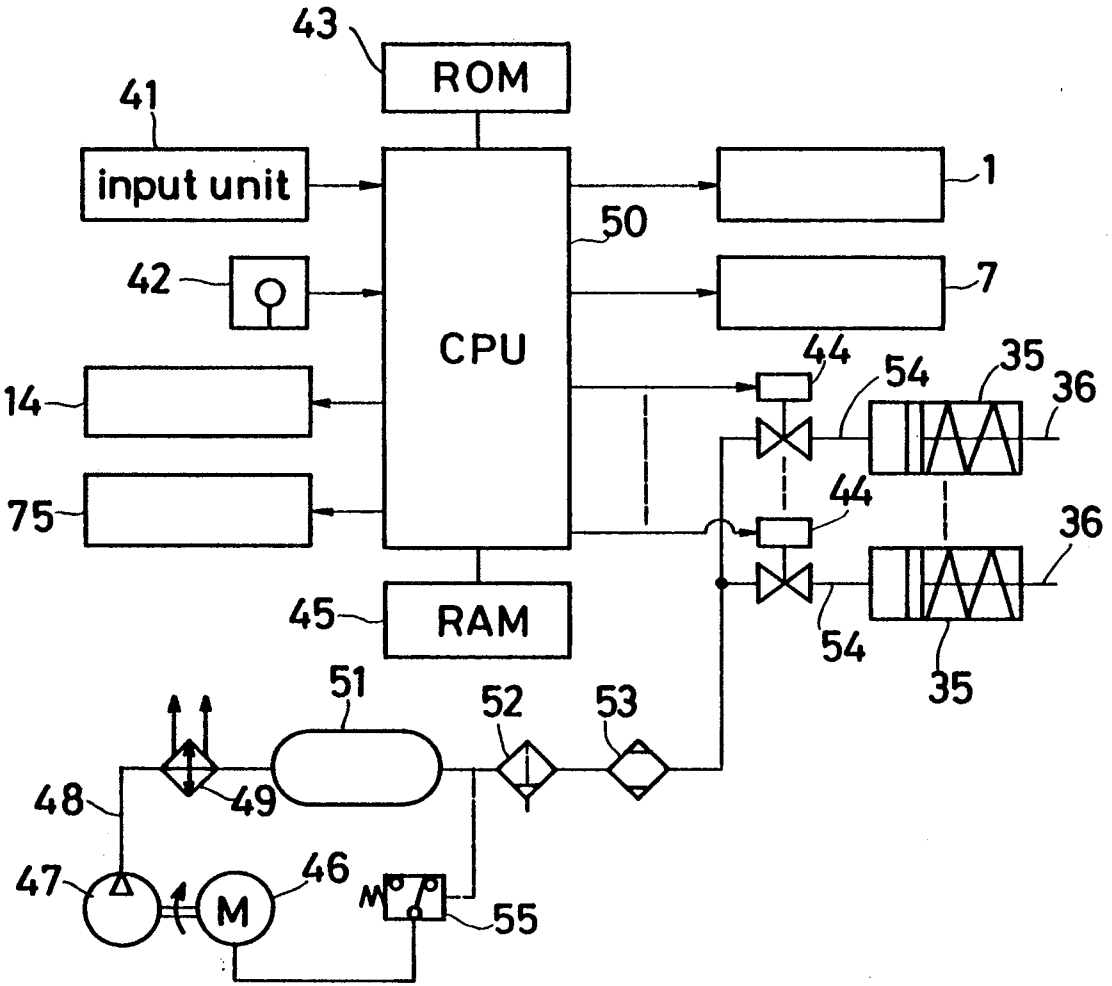
FIG. 7 is a system diagram of a control circuit and a pneumatic circuit.

FIG. 7 shows a control circuit for the shearing apparatus. A CPU 50 is operable in response to input signals received from an input unit 41 and a floppy disk 42 storing design patterns, to drive and control the spiral cutter 1, transport device 7, electromagnetic valves 44 for driving the air cylinders 35, and first lifting device 14 in accordance with programs stored in a ROM 43. A RAM 45 stores necessary data such as data for setting the first gap g1 corresponding to the type of pile fabric 6.

FIG. 7 also shows a pneumatic circuit for supplying compressed air as drive source to the respective air cylinders 35.

Specifically, an air compressor 47 driven by a motor 46 has a discharge line 48 to which respective air supply lines 54 are connected through an after cooler 49, an air tank 51, a main line filter 52 and a dryer 53. Each air supply line 54 has one of the electromagnetic valves 44. A pressure switch 55 is provided which is operable by a downstream pressure of the air tank 51. When the downstream pressure exceeds a predetermined pressure, the pressure switch 55 outputs a signal to the motor 46 for stopping rotation thereof.

Figure 8:
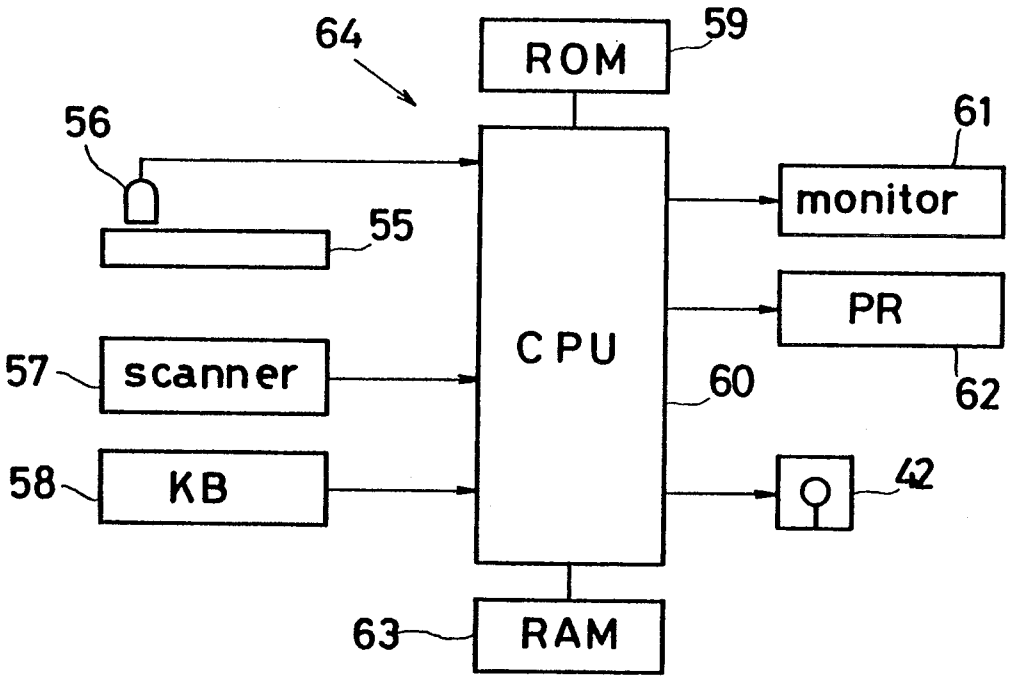
FIG. 8 is a block diagram of a control circuit for pattern setting.

FIG. 8 shows a control circuit for setting a design pattern. A CPU 60 is operable in response to signals received from a cursor 56 acting as an image position designating device for scanning an upper face of a tablet (digitalizer) 56 for digitalizing images, a scanner 57 acting as an automatic scanning device and a keyboard 58, to drive and control a monitor 61, a printer 62 and a floppy disk 42 in accordance with programs stored in a ROM 59. A RAM 63 stores necessary data.

This pattern setting device 64 sets a pile clipping pattern for clipping the piles on the pile fabric 6. The pattern set by this device is visually displayed on the monitor 61, printed out by the printer 62, and at the same time stored on the floppy disk 42. Thus, the set pattern is stored on the floppy disk 42 in advance by the pattern setting device 64 shown in FIG. 8. Then, this floppy disk 42 is connected to the control circuit shown in FIG. 7, whereby the CPU 50 drives and controls the various devices 1, 7, 14 and 44. It is desirable in this case to synchronize transport speed of the pile fabric 6 and transmission speed of signals for turning the electromagnetic valves 44 on and off.

Figure 9:
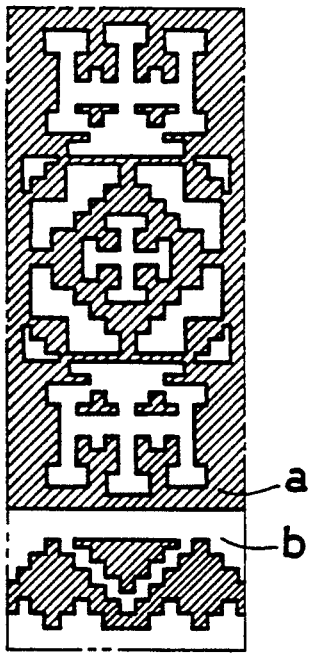
FIG. 9 is an explanatory view of one example of design patterns.

FIG. 9 shows one example of design patterns. For expediency of illustration, hatched portions a represent portions having long piles, and blank portions b represent portions having short piles. In FIG. 1, numeral 65 denotes a guide roller.

The illustrated embodiment has the foregoing construction. Functions of this embodiment will be described hereinafter.

First, the pattern setting device 64 is operated to set a pile clipping pattern. The information thus set is stored on the floppy disk 42. Next, this floppy disk is connected to the CPU 50 in the control circuit shown in FIG. 7, and the input unit 41 is operated.

When the input unit 41 is operated, the spiral cutter 1 rotates in the direction of an arrow in FIG. 1, and the transport device 7 feeds the pile fabric 6 in the direction of the different arrow in FIG. 1. The electromagnetic valves 44 and air cylinders 35 move the plurality of elements 27 up and down in accordance with the pattern stored on to the floppy disk 42 in advance.

When the elements 27 are in a lowered position A as shown in FIG. 2, a large space is formed between the upper ends of the thick heads 29 and the spiral cutter 1. Consequently, the piles 5 are sheared to a long pile length for the hatched portions a in FIG. 9. When the elements 27 are in a raised position B, a reduced space is formed between the upper ends of the thick heads 29 and the spiral cutter 1. Consequently, the piles 5 are sheared to a short pile length for the blank portions b in FIG. 9.

The plurality of elements 27 arranged close to one another over the entire axial length of the spiral cutter 1 are moved up and down through the electromagnetic valves 44 and air cylinders 35 according to the set pattern. As a result, the same clipping pattern as shown in FIG. 9 is formed on the pile fabric 6.

As described hereinbefore, each element 27 has a stepped structure with a difference in wall thickness between the thick head 29 and thin main body 28, and the leg 30 is formed integral with the thin main body 28 in a position offset from the legs 30 of adjacent elements 27. The air cylinders 35 have the piston rods 36 arranged in opposed relations with the respective legs 30. Thus, the air cylinders 35 may be arranged such that cylinder tubes of the air cylinders 35 do not interfere with one another in spite of their outside diameter. Moreover, the thick heads 29 of the elements 27 may be arranged close to one another with no gaps in between over the entire axial length of the spiral cutter 1.

As a result, no gaps are formed between adjacent thick heads 29 as distinct from the prior art. This provides the advantage of producing fine design patterns.

In addition, the movable element cover 13 is vertically adjustable by the first lifting device 14. When shearing long piles of the pile fabric 6 such as a blanket, the entire shearing table 3 may be slightly lowered by the lifting base 8, with the movable element cover 13 raised by the first lifting device 14, thereby to increase the first gap gl. Then, a clipping operation suited to the pile fabric 6 having the long piles may be carried out since the elements 27 are projected by an amount corresponding to the increased first gap g1.

When shearing short piles of the pile fabric 6 such as a sheet for use in an automobile, the entire shearing table 3 may be slightly raised by the lifting base 8, with the movable element cover 13 lowered by the first lifting device 14, thereby to decrease the first gap g1. Then, a clipping operation suited to the pile fabric 6 having the short piles may be carried out since the elements 27 are projected by an amount corresponding to the decreased first gap g1.

In this way, the single shearing apparatus is capable of carrying out shearing operations suited to all types of pile fabrics 6, regardless of the pile length.

The movable element cover 13 may be raised and lowered by means of the first lifting device 14 to a desired position by operating a push button switch, for example, while visually observing indications given on the display based on the signal from the digital scale 37.

FIGS. 10 through 13 show a shearing apparatus in a different embodiment of the invention. The preceding embodiment is constructed to carry out a single-stage clipping operation for the pile fabric 6. The embodiment shown in FIGS. 10 through 13 is adapted for a double-stage clipping operation for the pile fabric 6.

Figure 12:
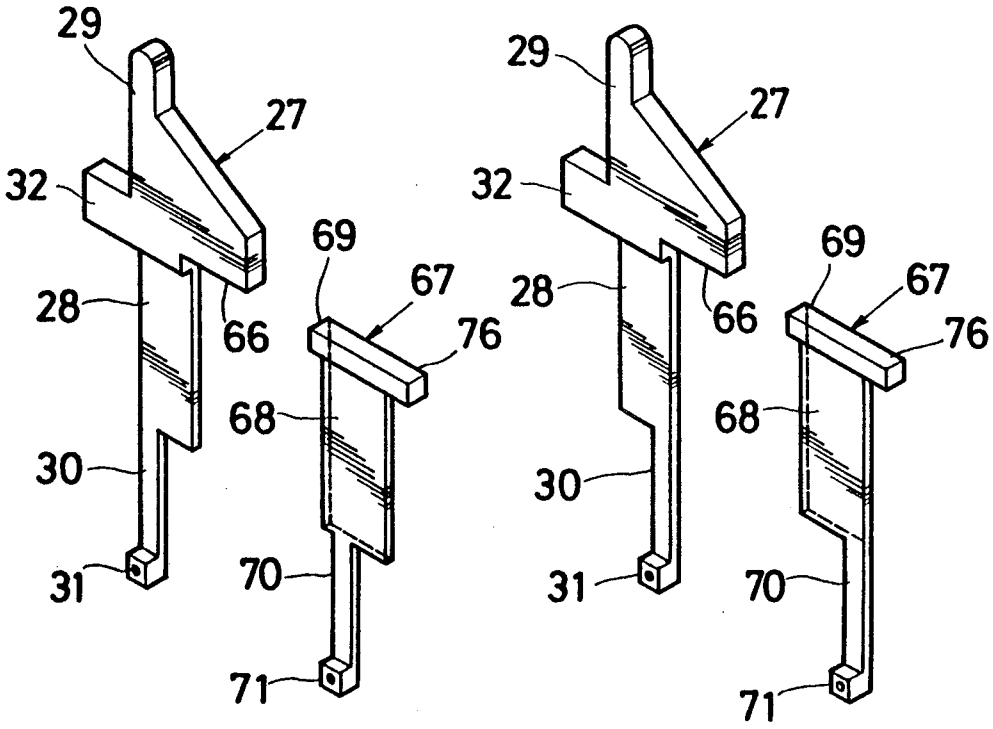
FIG. 12 is an exploded perspective view of elements and sub-elements.

As shown in FIG. 12, the thick head 29 of each element 27 is cut out at a lower end of the other side thereof to define a recess 66. A sub-element 67 is interposed between this recess 66 and each slit 26 of the element block 25. Thus, a total of two components, the element 27 and sub-element 67, are inserted into the single slit 26.

Figure 10:
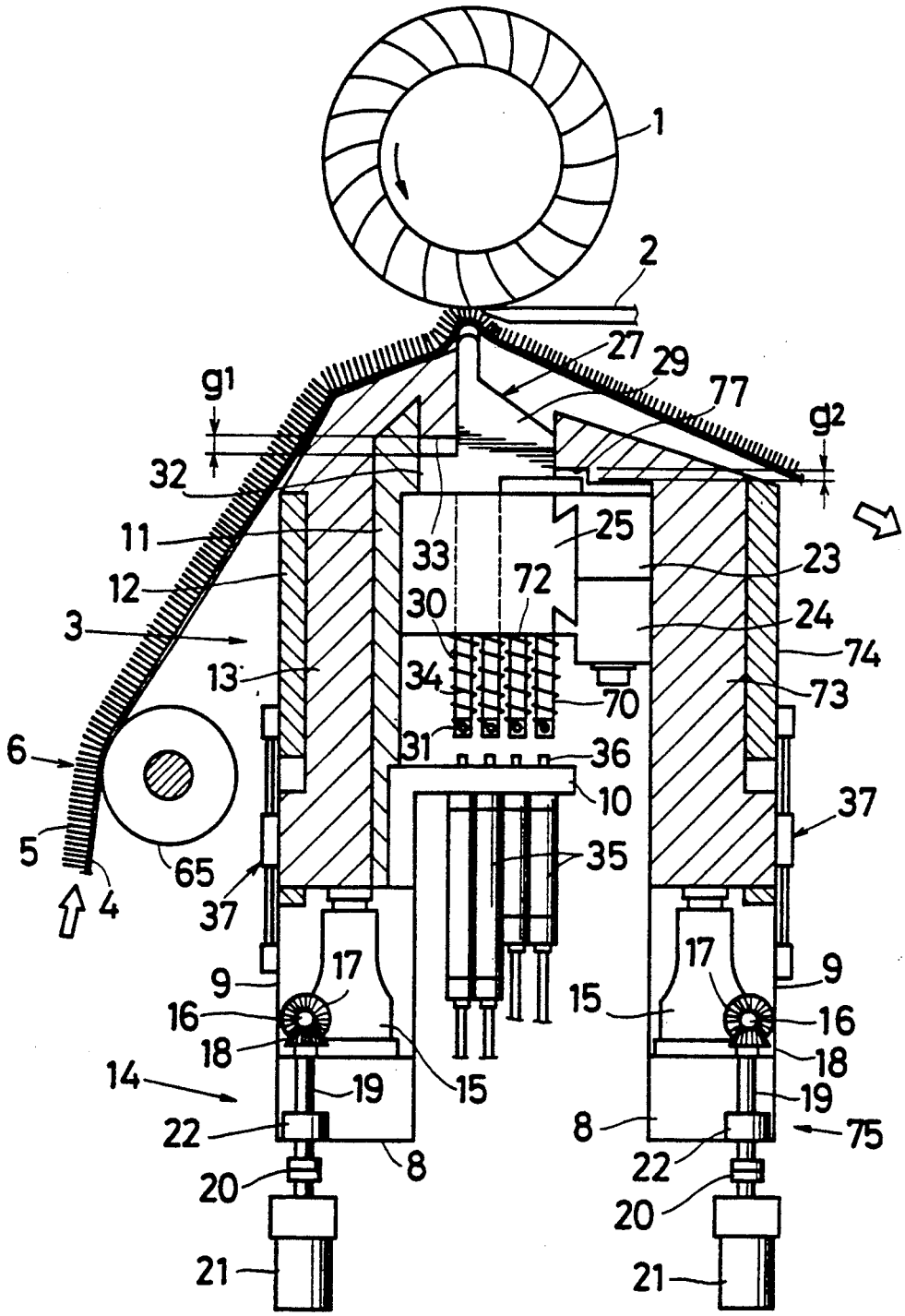
FIG. 10 is a side view of a shearing apparatus in a different embodiment of this invention.
Figure 11:
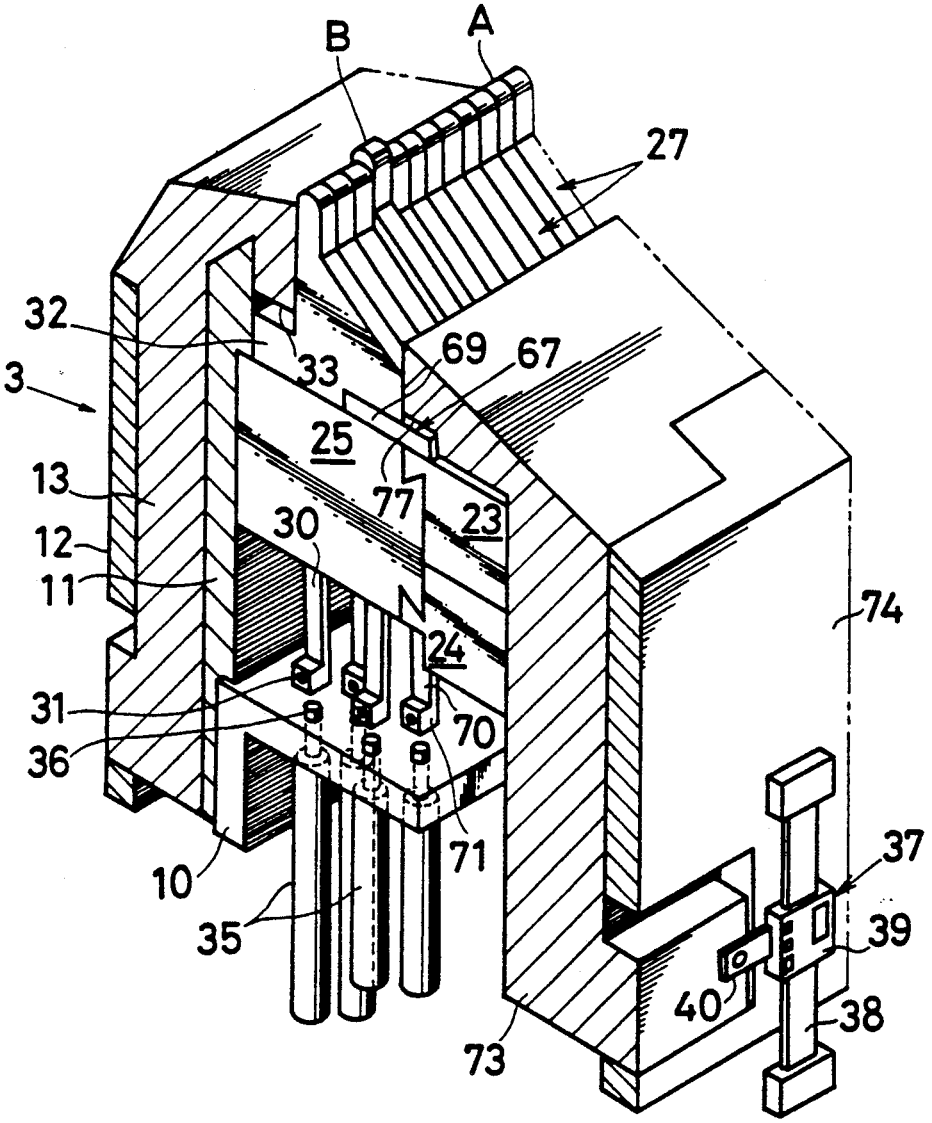
FIG. 11 is a perspective view of a principal portion of the apparatus shown in FIG. 10.

Each sub-element 67 includes a main body 68 having a wall thickness of about 1.35 mm, a crest 69 formed integral with an upper end of the main body 68 and having a wall thickness of about 2.5 mm, a leg 70 formed integral with a lower end of the main body 68 and having the same wall thickness as the main body 68, and a retainer 71 formed integral with a lower end of the leg 70 and having the same wall thickness as the crest 69. As shown in FIGS. 10 and 11, the crest 69 projects to the other side from the recess 66 of the element 27.

As is the leg 30 of each element 27, the leg 70 of each sub-element 67 is offset from the legs 70 of adjacent sub-elements 67.

Both the element 27 and sub-element 67 are vertically movably inserted into a single slit 26. The elements 27 and sub-elements 67 are arranged close to one another over the entire axial length of the spiral cutter 1, with the thick heads 29 of the numerous elements 27 defining no gaps in between, and the crests 69 of the same number of sub-elements 67 also defining no gaps in between.

Figure 13:
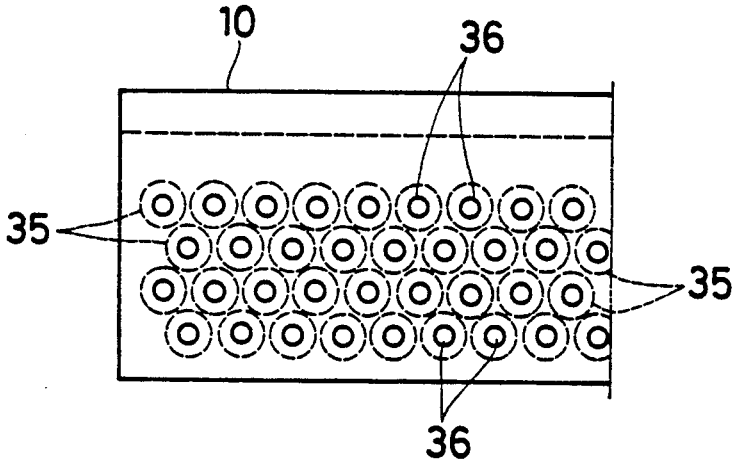
FIG. 13 is a partial plan view of an air cylinder mounting structure.
Figure 14:
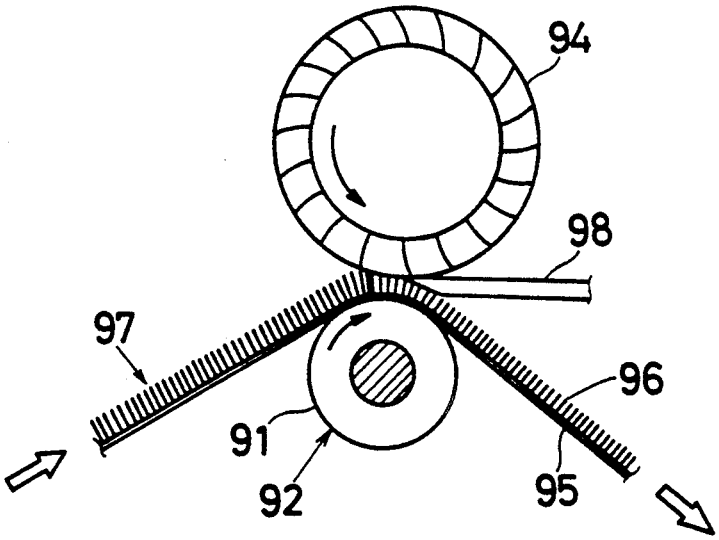
PRIOR ART FIG. 14
FIG. 14 is a side view of a conventional shearing apparatus.
Figure 15:
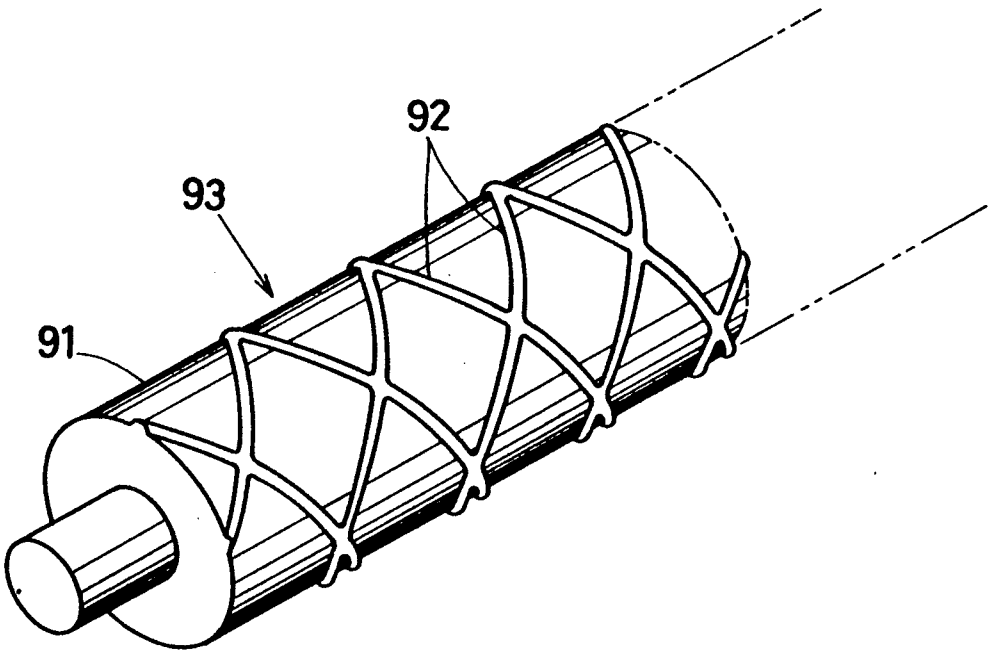
PRIOR ART FIG.15
FIG. 15 is a partial perspective view of a rotating roll shown in FIG. 14.

A coil spring 72 is mounted between the bottom surface of the element block 25 and the retainer 71 of each sub-element 67 This coil spring 72 constantly biases each sub-element 67 to a lower normal position. The cylinder mounting block 10 disposed under the element block 25 has piston rods 36 of air cylinders 35 arranged in positions opposed to the mutually offset legs 30 and 70 as shown in FIG. 13.

Taking strokes into consideration, the air cylinders 35 opposed to the elements 27 have a long overall length, while the air cylinders 35 opposed to the sub-elements 67 have a relatively short overall length.

In addition, as shown in FIG. 10, this embodiment includes a further lifting base 8 disposed on the other side of the element block 25. This lifting base 8 carries a movable element cover 73 and a stationary clement cover 74 erected thereon through a supporter 9. A second lifting device 75 having the same construction as its counterpart in the preceding embodiment is interposed between the lifting base 8 and movable element cover 73.

The movable element cover 73 includes a second stopper 77 opposed to an upper surface 76 of a projecting portion of the crest 69 of each sub-element 67. A second gap g2 is formed between the upper surface of the projection 76 and the second stopper 77. The second gap g2 is adjustable by driving the second lifting device 75, and is differentiated in size from the first gap g1.

In the embodiment shown in FIGS. 10 and 11, the first gap 1 is larger than the second gap g2. However, this setting may of course be reversed. This embodiment is the same as the preceding embodiment in the other aspects. In FIGS. 10 through 13, therefore, like parts are labeled with like reference numerals with respect to the preceding drawings, and will not be described again.

According to the illustrated construction, when the air cylinders 35 corresponding to the sub-elements 67 are driven, the elements 27 are raised through the sub-elements 67 by an amount corresponding to the second gap g2. When the air cylinders 35 corresponding to the elements 27 are driven, the elements 27 are raised by the amount corresponding to the first gap g1. Since the first gap g1 is larger than the second gap g2, this construction provides the advantage of clipping the piles 5 in two stages. This enables further diversified ultra-fine design patterns to be produced.

In the above embodiment, the worm jack 15 is employed as a component of each of the first and second lifting devices 14 and 75. However, this worm jack 15 may be replaced with a rack and pinion mechanism. Further, an optical disk or laser disk may be used instead of the floppy disk to store pattern information.

What is claimed is:

1. A shearing apparatus for shearing, between a spiral cutter and a lower blade, tip ends of numerous piles formed on a foundation of a pile fabric, said shearing apparatus comprising:

a plurality of elements each including a thin main body vertically movably mounted in a slit defined in an element block, and a thick head formed integral with said thin main body for pressing said foundation toward said spiral cutter;

the thick heads of said elements being arranged close to one another without gaps in between over an entire axial length of said spiral cutter;

each of said elements further including a leg formed integral with a lower portion of said thin main body to be offset from legs of adjacent elements; and a cylinder mounting block disposed below said element block and having piston rods of air cylinders arranged in positions opposed to the respective legs.

2. A shearing apparatus as claimed in claim 1, wherein said thick head of each of said elements has a projection formed on one side thereof, said apparatus further comprising a movable element cover disposed on the one side and including a first stopper opposed to an upper surface of said projection, said movable element cover disposed on the one side having first lifting means connected thereto for adjusting a first gap between said upper surface of said projection and said first stopper.

3. A shearing apparatus as claimed in claim 2, wherein said thick head of each of said elements defines a recess in a lower end on the other side thereof, said apparatus further comprising sub-elements each interposed between said recess and the slit of said element block and having a crest projecting from said recess to the other side, each of said sub-elements having a leg formed integral with a lower end thereof to be pushed by the piston rod of one of said air cylinders, said apparatus further comprising a movable element cover disposed on the other side and including a second stopper opposed to an upper surface of the projecting crest, said movable element cover disposed on the other side having second lifting means connected thereto for adjusting a second gap between said upper surface of said projection and said second stopper, said second gap being different in size from said first gap.

* * * * *